US005381984A

United States Patent [19]

Hindsgual

[11] Patent Number: 5,381,984

[45] Date of Patent: Jan. 17, 1995

[54] TUBULAR BODY, ESPECIALLY AS A CORE ELEMENT, AND ROLL WITH A CORE ELEMENT

[75] Inventor: Kim Hindsgual, Oslo, Norway

[73] Assignee: Hygoform A.S., Oslo, Norway

[21] Appl. No.: 1,553

[22] Filed: Jan. 6, 1993

[30] Foreign Application Priority Data

Jun. 2, 1992 [NO] Norway ..... 922177

[51] Int. Cl.[6] ..... B65H 16/02; B65D 85/66; A24F 15/00; A47K 13/14

[52] U.S. Cl. ..... 242/613.5; 242/905; 428/43; 428/905; 206/389; 206/390; 206/416; 4/244.1; 4/244.2; 4/245.1; 4/245.2; 4/245.8

[58] Field of Search ..... 428/43; 4/244.1, 244.2, 4/245.1, 245.2, 245.8; 242/55.53, 55.3, 55.2, 613.5, 905; 206/389, 390, 416

[56] References Cited

U.S. PATENT DOCUMENTS

| | | | |
|---|---|---|---|
| 2,241,171 | 5/1941 | Wallace | 4/245.8 |
| 2,546,820 | 4/1947 | Grant | 242/55.2 |
| 2,639,939 | 5/1953 | Matchett . | |
| 2,753,209 | 7/1956 | Klasky . | |
| 3,002,704 | 10/1961 | Grossfeld . | |
| 3,329,367 | 7/1967 | Paradiso . | |
| 3,620,465 | 11/1971 | Wyatt et al. | 242/55.22 |
| 4,193,144 | 3/1980 | McNally | 4/229 |
| 4,566,648 | 1/1985 | Hefty | 4/245.2 |
| 4,566,648 | 1/1985 | Hefty | 4/245.2 |
| 4,627,117 | 12/1986 | Morishita | 428/43 |
| 4,926,506 | 5/1990 | Wang | 4/243.1 |
| 5,107,549 | 4/1992 | Pitts et al. | 4/245.2 |

FOREIGN PATENT DOCUMENTS

| | | |
|---|---|---|
| 3329155 | 8/1989 | Germany . |
| 1486901 | 9/1977 | United Kingdom . |
| 2163786 | 3/1986 | United Kingdom . |

*Primary Examiner*—George F. Lesmes
*Assistant Examiner*—Kathryne E. Shelborne
*Attorney, Agent, or Firm*—Young & Thompson

[57] ABSTRACT

A core element (14) for a roll of wound-up web material, especially a lavatory seat protection cover, is described. The core element is made in the form of a tubular body having two ends, each with a respective end stopper (16). The core element (14) contains a fragrance carrier (20). The core element can be used in a roll, for example a roll of protective covering for a lavatory seat, or toilet paper, or similar. The core element can also be used as a winding-on element for used protective covering for a lavatory seat. The end stoppers (16) protect the fragrance carrier prior to use.

1 Claim, 3 Drawing Sheets

5
23
6
13
25
4
7
3
9
8
14
28
11
12
15
2
10
1

TUBULAR BODY, ESPECIALLY AS A CORE ELEMENT, AND ROLL WITH A CORE ELEMENT

FIELD OF THE INVENTION

The invention relates to a tubular body, especially as the core element of a roll for a wound-up web material, especially, a lavatory seat protective cover, having two ends preferably designed for mounting on suitable supports.

BACKGROUND OF THE INVENTION

The invention has been especially developed in connection with a device for applying a protective cover to a lavatory seat and displacing the cover therealong. In devices of this kind, a hose-like protective cover is drawn from one roll onto a second roll, the hose being drawn on to the lavatory seat at the open end thereof, and then being fed along and around the lavatory seat and led off at the other, fixed end of the lavatory seat where there is a knife which cuts the hose so that it can be drawn off and over onto a receiving roll. Another variant is one where the cover material or protective cover is not in the form of a complete stocking or hose. The start material therein is a web-formed cover material which is folded in the longitudinal direction and is pulled out from a supply roll at one end of the seat. The material is thereafter made to envelop the body of the seat. The seat has a slit for guiding the material, the edges of the slit being furnished with a collar in order to guide the material into the slit, and both ends of the seat are attached to and arranged at a distance from the lavatory bowl. At the other end of the seat there is a receiving roll which takes up the used material while drawing out new material from the supply roll.

The invention, as will be made apparent hereinbelow, is not restricted to use in connection with protective covers for lavatory seats, but can also be used to advantage with, for example, rolls of lavatory paper. The primary purpose of the invention is namely to make possible controlled, brief emission of a fragrance, particulary in toilets. A number of different "automatic machines" are known for the emission of a fragrance. These devices may be of the continuously functioning type, i.e., that they are, in effect, nothing more than a container which contains a fragrance emitting agent, or devices that can be time-controlled in such a way that they only emit the fragrance at regular intervals. Devices are also known where the user actuates the fragrance emitting device by, for example, pressing a button. An obvious disadvantage with the prior art is that one either has a fragrance emission that is too powerful (constantly functioning equipment) or, as an extreme consequence, one does not have any fragrance emission at all because the user quite simply forgets to press the button or control handle. Time-controlled equipment offers a remedy to a certain extent here, but experience has shown that they emit either too much or too little fragrance, because the time-set emission does not correspond with actual needs. An objective of the invention is therefore to make possible an emission of fragrance which concurs with the need, i.e., each time a user, for example, comes into the toilet.

SUMMARY OF THE INVENTION

According to the invention, a tubular body is therefore proposed as mentioned by way of introduction, characterized in that it is designed to contain in its interior a fragrance carrier, and in that the two ends are designed for the insertion of a respective end stopper.

When, for example, providing a roll of wound-up lavatory seat protective covering, the protective covering is wound up on a core element according to the invention. The core element is furnished with a fragrance carrier which is placed inside the core element, the core element is then closed at both ends by means of respective end stoppers in such a way that the fragrance carrier lies protected inside the finished roll. When a roll of this kind is put in a housing connected to a lavatory seat on to which the protective cover is to be fed, the two end stoppers are removed and the roll is mounted by means of the core element on suitable supports. The fragrance carrier will now lie open (the two supports are supplied with ventilation apertures), but will, by the selection of a suitable fragrance carrier, emit only a mild fragrance. It is only when the roll is put into use, i.e., that one by means of suitable means draws a length of the protective covering over the lavatory seat, that a suitable fan will be activated briefly and draw or send air through the core element. This air passes by the fragrance carrier and activates it so that it emits fragrance. The fan is provided with a time control which causes the fan to function for a relatively short time.

In this way, it is ensured that the fragrance is, in the main, only emitted briefly each time there is a real need for the emission of fragrance.

On the inside of the core element, and at least at the ends thereof, it is advantageous if there are longitudinal, radially inwardly projecting ribs. The ribs serve to hold the fragrance container, and serve also as guiding elements when mounting the core element on the mounts, as well as guiding means for the respective end stoppers. At the other end of the lavatory seat where the optionally hose-shaped protective cover is cut, the protective cover is wound on to a similar core element, and the aforementioned ribs can then advantageously be used as a drive coupling element.

Here, it should be mentioned that the core element containing the fragrance carrier can, of course, not only be used in a roll of wound-up protective covering, ready for use, but can also be used for winding on or winding up used protective covering, with the emission of fragrance when the core element is actuated to wind up the covering.

The invention relates thus also to a core element for a roll of wound-up web material, in particular a lavatory seat protective cover, comprising a tubular body having two ends designed to be mounted on suitable supports, characterized in that the core element contains in its interior a fragrance carrier, and in that the ends of the core element are closed by means of respective end stoppers.

On the inside of the core element, and at least at the ends thereof, it is advantageous if there are longitudinal, radially inwardly projecting ribs, at the same time as the end stoppers are shaped in such a way as to be at least partially inserted into the respective end opening, and have radial grooves for engaged interaction with the ribs.

The purpose of the ribs is as mentioned hereinabove. It would be of particular expedience for each end stopper to have an externally accessible grip ring. A grip ring of this kind would facilitate the removal of the end stopper.

The invention also relates to a roll of wound-up web material, especially a lavatory seat protective cover, with a tubular core element having two ends formed for mounting on suitable supports, characterized in that the core element contains in its interior a fragrance carrier, and in that the ends of the core element are closed by means of a respective end stopper. In a roll of this kind, it is of particular advantage if on the inside of the tubular core element, and at least at one end thereof, there are longitudinal, radially inwardly projecting ribs, while the end stoppers are designed so as to be at least partially inserted into the respective end opening, and have radial grooves for engaged interaction with the ribs. In this case, too, it would be of advantage if the end stoppers were to have an externally accessible grip ring.

The invention also relates to a mounting arrangement for a core element of a roll of wound-up web material, especially a lavatory seat protective cover, the core element being in the form of a tubular body having two ends, the mounting arrangement being characterized by respective ventilated supports for support interaction with a respective end of the core element, as well as an attached fan means having an activating means which is actuated when the core element is caused to rotate on the supports, and is constructed so as to switch off the fan after a certain amount of time.

What is meant by ventilated supports here are supports which allow air to pass through, in and out, respectively, of the tubular core element. When the core element is actuated so as to rotate, for example when a receiving roll for the lavatory seat protective cover is rotated, the fan will be switched on and will send air through the core element and also possibly through the second core element, where the unwinding takes place. A similar arrangement can also be used for a toilet paper roll, where air will thus be sent through the core element for a short time each time paper is pulled off the roll. It will be understood that the invention may, of course, be accomplished in connection with, for example, towel machines, soap dispensers, etc.

BRIEF DESCRIPTION OF THE DRAWINGS

The invention shall now be explained in more detail with reference to the drawings, where.

DETAILED DESCRIPTION OF THE INVENTION

Figure 5:
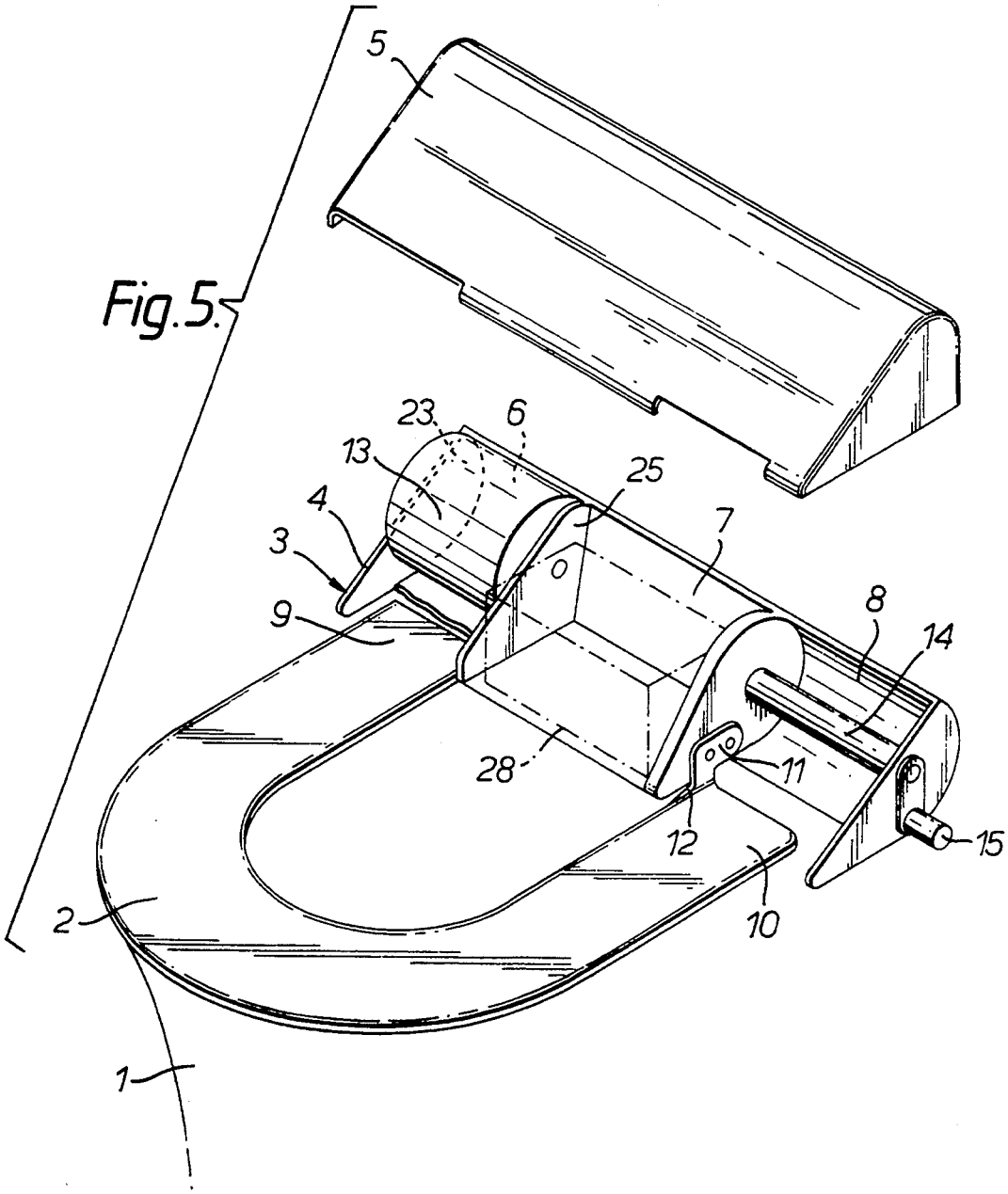
FIG. 5 shows in perspective outline a lavatory seat arrangement with a lavatory seat on to which a protective cover is fed.
Figure 6:
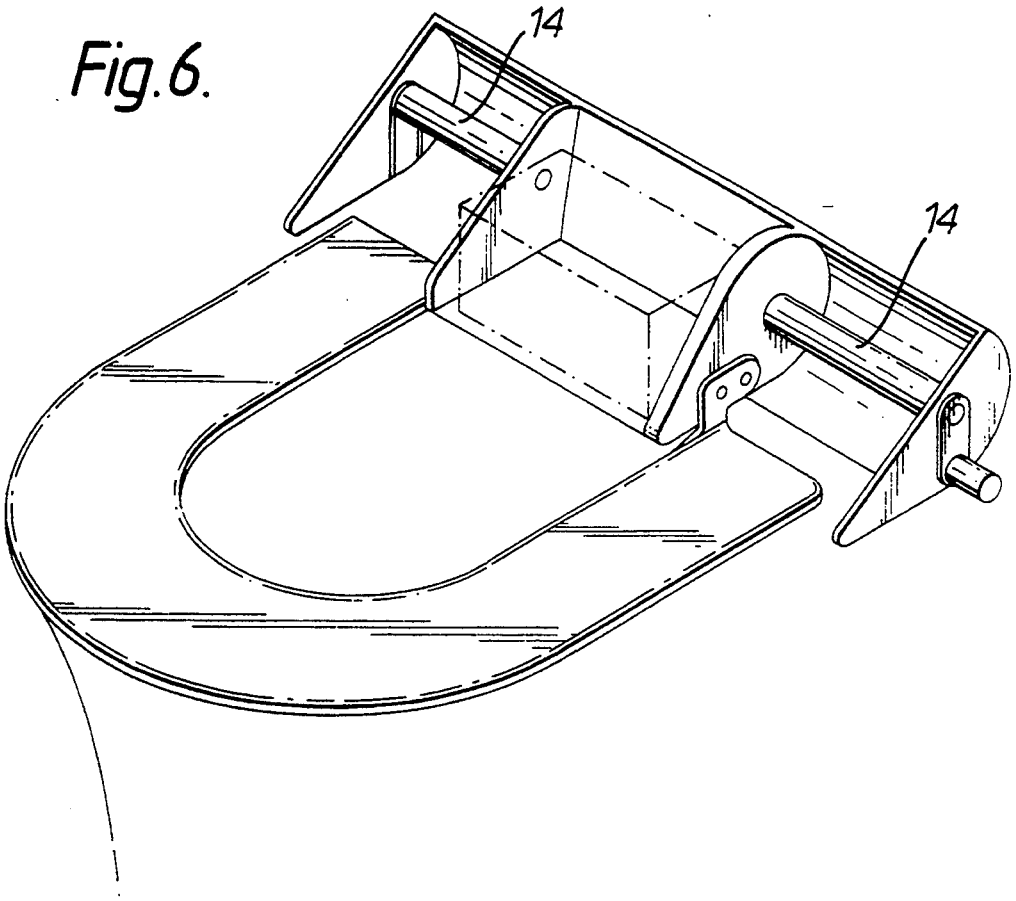
FIG. 6 shows the device in FIG. 5 without the top cover for the roll receiving housing, and shown with the empty core element.

In order to describe the core element in more detail, a brief description of the lavatory seat means in FIGS. 5 and 6 shall be given. In FIGS. 5 and 6, a lavatory bowl 1 is indicated with a seat 2. On the back edge of the lavatory bowl 1, a housing 3 is mounted. The housing 3 comprises a base component 4, which is secured to the lavatory bowl 1, and a top component 5, which is shown in FIG. 5, loosened and lifted somewhat, so that the inside of the housing can be seen.

The base component of the housing is, as shown, divided up three chambers 6, 7 and 8. One of the final end sections 9 of the ring-like lavatory seat 2 rests loosely in the chamber 6 of the housing, while the other final end section 10 is secured in the chamber 8 of the housing, as indicated, by means of the bracket 11. In the contact area of the bracket 11, a knife element 12 is arranged for cutting the protective cover, not illustrated here. The protective cover comes from a storage roll 13 in the chamber 6 of the housing, and is fed on to the final end section 9 of the seat and around the seat until it reaches the end section 8, where, in this case, the stocking-formed protective cover is split by means of the knife 12, and passes on to a core element 14 which is mounted in the chamber 8 of the housing. The core element 14 can be rotated by means of a crank 15. The roll 13 has a similar core element, see FIG. 6, where the roll has been omitted and only the two empty core elements 14 can be seen.

Figure 1:
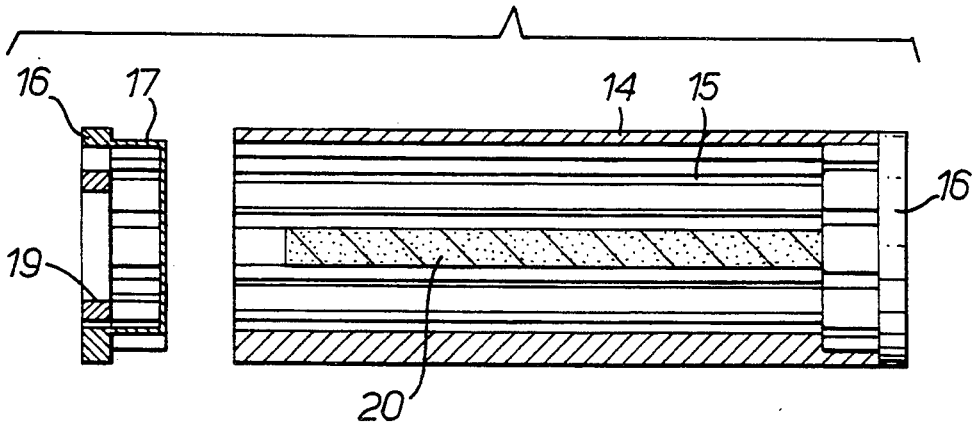
FIG. 1 shows a longitudinal section through a core element according to the invention.
Figure 2:
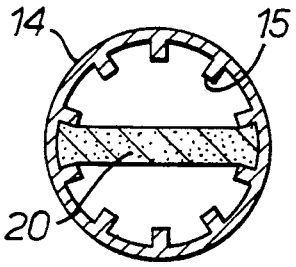
FIG. 2 shows a cross section of the core element in FIG. 1.
Figure 3:
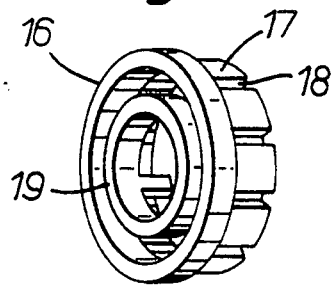
FIG. 3 shows a perspective outline of an end stopper as shown in FIG. 1.
Figure 4:
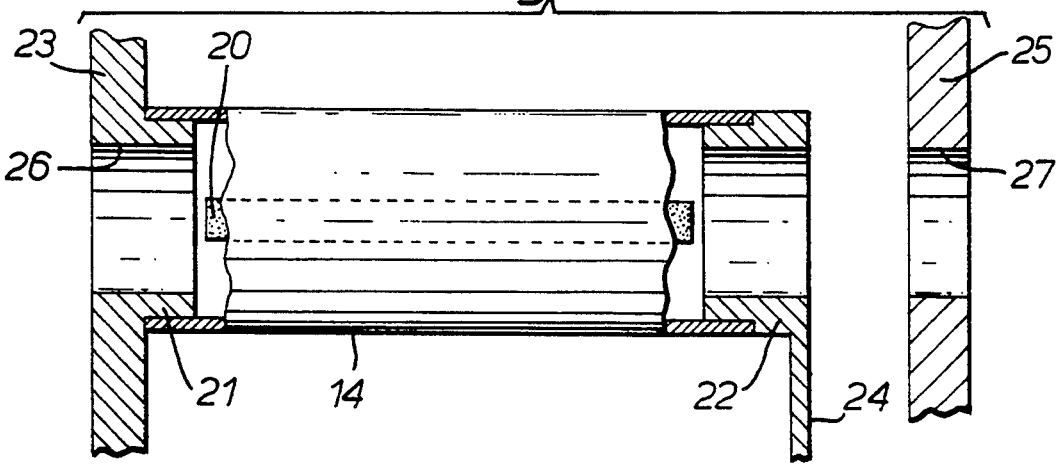
FIG. 4 illustrates more schematically how the core element may be mounted on interacting ventilated supports.

A core element 14 can, for example, have the appearance as shown in FIGS. 1 to 3, and be mounted as shown schematically in FIG. 4.

The core element 14 shown in FIGS. 1 and 2 in a longitudinal section and a cross section, respectively, has the form of a tubular body having longitudinal, radially inwardly projecting ribs 15. The tubular body is furnished with an end stopper 16 at each end. The end stopper is cup-shaped, as shown in the section through the left-hand end stopper in FIG. 1, see also FIG. 3, and has a part 17 designed to fit into the corresponding end opening in the core element 14. This part is provided with grooves 18 designed to interact with the ribs 15. On the outside, in the cup cavity, the end stopper 16 has a grip ring 19. The grip ring serves to facilitate the removal of the end stopper from the tubular body 14. It is of advantage to use a suitable plastic as the material for the core element 14, for both the tubular body and the end stoppers.

A fragrance carrier 20 is placed inside the tubular body. It would be an advantage if this were to be of the so-called dry type, for example a spongy body which only emits a mild fragrance and is only activated when a stream of air is forced to move through the tubular body 14 and thereby sweep over the fragrance carrier. The fragrance carrier 20 is held in place between longitudinal ribs 15, as shown especially in the cross section in FIG. 2.

In FIG. 4, it is shown how the core element 14 can be mounted on ventilated supports 21, 22. The support 21 is, in effect, only against a wall 23 which may, for example, be the wall 23 shown in FIG. 5 between the chambers 7 and 8 in the housing 3.

The second support is a corresponding hollow end piece which is fixed on a spring am 24, which is in turn mounted onto the wall 25 (see also FIG. 5). In both walls 23 and 25, openings 26, 27 have been made, which allow through passage of a flow of air. The supports in FIG. 4 are formed with smooth circumferences, so that the core element can rotate freely. On the winding-on side, the storage arrangement is more or less identical, but the crank 15 is connected in an expedient manner, so that it, possibly with a hollow pin with external ribs, can engage with and interact with the ribs inside the core element, in such a way that the core element can thereby be rotated. Further details relating to this mounting are neither shown nor described since it is a matter of simple mechanics, which can be put into effect without more information by a person skilled in the art.

In the central chamber 7 in the housing, a small fan unit 28 is indicated in broken lines. The fan unit comprises an activating means which, in a manner not shown in more detail, is actuated when the core element 14 is made to rotate by means of the crank 15. This causes a current then to be released from a battery which operates the fan, which in turn will send a flow of air through one of the core elements, normally the core element 14 in the unwinding roll 13. The fragrance carrier 20 is thereby activated. The activating means in the fan unit is such that after a short period of time the current to the fan is interrupted. The fan stops and thus, in effect, the fragrance carrier is switched off as an actively emitting body.

It will be understood that in this way a situation is achieved wherein the fragrance carrier only emits its fragrance each time the toilet is, in fact, in use because it is then that the user makes a new length of protective covering rotate forward from the roll 13.

Figure 7:
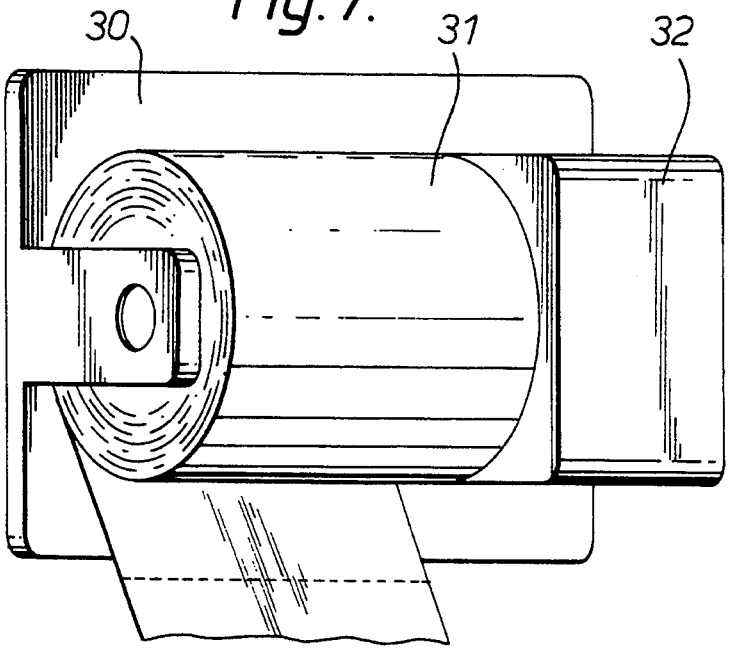
FIG. 7 shows in perspective outline a toilet roll means where the invention has been implemented.

The invention can, as mentioned, also be implemented, for example, in connection with a toilet paper roll. This is shown in a totally schematic way in FIG. 7, where a toilet paper holder 30 is shown, wherein there is a rotatably mounted roll of toilet paper 31, by making use of the core element according to the invention. A small fan unit is located in a housing 32. When a length of toilet paper is pulled off the roll, the core element will be rotated and will activate the fan unit 32, which then sends a flow of air through the hollow core element, with the corresponding activation of the fragrance carrier mounted in said core element. In the same way as in the toilet arrangement in FIG. 5, the fan unit 32 is constructed in such a way that it stops after a short time, thereby deactivating the fragrance carrier.

The essential aspect of the invention is that the fragrance carrier is only activated each time an attached means is used. For example, the fragrance carrier can be incorporated in a soap dispenser. When a button or handle is pressed in order to obtain soap, the fragrance carrier is activated simultaneously.

I claim:

1. A core element for a roll of wound-up web material, comprising a tubular body having two ends, radially projecting ribs means extending longitudinally between said ends, said ribs extending equal distances inwardly, thereby forming a discontinuous rotational inner bearing surface at each end, imperforate end closures removably inserted in said tubular body ends, said end closures having radial groove means receiving said rib means, each end closure having an externally accessible grip ring, and a fragrance carrier in said tubular body.

* * * * *